US006703816B2

(12) United States Patent
Biagi et al.

(10) Patent No.: US 6,703,816 B2
(45) Date of Patent: Mar. 9, 2004

(54) COMPOSITE LOOP COMPENSATION FOR LOW DROP-OUT REGULATOR

(75) Inventors: Hubert J. Biagi, Tuscon, AZ (US); Haoran Zhang, Tuscon, AZ (US); Thomas L. Botker, Tuscon, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/190,931

(22) Filed: Jul. 8, 2002

(65) Prior Publication Data

US 2003/0178980 A1 Sep. 25, 2003

Related U.S. Application Data

(63) Continuation-in-part of application No. 10/151,366, filed on May 20, 2002, and a continuation-in-part of application No. 10/107,270, filed on Mar. 25, 2002.

(51) Int. Cl.[7] ..... G05F 1/40

(52) U.S. Cl. ..... 323/280; 323/281; 323/275; 327/553; 327/555

(58) Field of Search ..... 323/280, 281, 323/274, 275, 277; 327/465, 553, 554, 555

(56) References Cited

U.S. PATENT DOCUMENTS 5,191,278 A * 3/1993 Carpenter ..... 323/275
5,559,424 A * 9/1996 Wrathall et al. ..... 323/277
5,861,736 A * 1/1999 Corsi et al. ..... 323/273
6,246,221 B1 * 6/2001 Xi ..... 323/280
6,465,994 B1 * 10/2002 Xi ..... 323/274
6,483,727 B2 * 11/2002 Oki et al. ..... 363/39
6,518,737 B1 * 2/2003 Stanescu et al. ..... 323/280
6,522,112 B1 * 2/2003 Schmoock et al. ..... 323/280

* cited by examiner

*Primary Examiner*—Shawn Riley
(74) *Attorney, Agent, or Firm*—W. Daniel Swayze, Jr.; W. James Brady; Frederick J. Telecky, Jr.

(57) ABSTRACT

A composite loop compensation circuit and method for a low drop-out regulator configured to facilitate stable operation at very low output load currents is provided. An exemplary low drop-out regulator includes an error amplifier, a pass device, and a composite loop compensation circuit. The compensation loop compensation circuit includes a plurality of segmented sense devices, a plurality of switches and a biasing component. The plurality of segmented sense devices are configured to sense an output load current, i.e., the current from the output terminal of the pass device. The plurality of switches are coupled between the plurality of segmented sense devices and a biasing component. Composite loop compensation circuit is configured to adjust the dominant first pole of the composite feedback loop based on the output load current through biasing of the active resistor component. As a result, the low drop-out regulator can include a very large pass device form addressing high currents and can remain stable for extremely low currents.

25 Claims, 3 Drawing Sheets

COMPOSITE LOOP COMPENSATION FOR LOW DROP-OUT REGULATOR

CROSS-REFERENCE TO RELATED APPLICATIONS

This application is a continuation-in-part and claims priority of pending U.S. application Ser. No. 10/107,270, entitled "Output Stage Compensation Circuit", filed on Mar. 25, 2002, and U.S. patent application Ser. No. 10/151,366, entitled "Low Drop-Out Regulator Having Current Feedback Amplifier and Composite Feedback Loop", filed on May 20, 2002, both incorporated herein by reference.

FIELD OF INVENTION

The present invention relates to power supply circuits. More particularly, the present invention relates to a composite loop compensation method and circuit, such as may be used with low drop-out regulators.

BACKGROUND OF THE INVENTION

The increasing demand for higher performance power supply circuits has resulted in the continued development of voltage regulator devices. Many low voltage applications are now requiring the use of low drop-out (LDO) regulators, such as for use in cellular phones, pagers, laptops, camera recorders and other mobile battery operated devices as power supply circuits. These portable electronics applications typically require low voltage and quiescent current flow to facilitate increased battery efficiency and longevity. The alternative to low drop-out regulators are switching regulators which operate as dc—dc converters. Switching regulators, though similar in function, are not preferred to low drop-out regulators in many applications because switching regulators are inherently more complex and costly, i.e., switching regulators can have higher cost, as well as increased complexity and output noise than low drop-out regulators.

Low drop-out regulators generally provide a well-specified and stable dc voltage whose input to output voltage difference is low. Low drop-out regulators are generally configured for providing the power requirements, i.e., the voltage and current supply, for any downstream portion of the electrical circuit. Low drop-out regulators typically have an error amplifier in series with a pass device, e.g., a power transistor, which is connected in series between the input and the output terminals of the low drop-out regulator. The error amplifier is configured to drive the pass device, which can then drive an output load.

To provide for a more robust low drop-out regulator, a large load capacitor is provided at the output of the low drop-out regulator. However, using large capacitors at the output of the low drop-out regulator requires a significant amount of board area, as well as increases manufacturing costs. Further, larger capacitors can tend to slow the response time down of the low drop-out regulator.

For example, with reference to FIG. 1, a prior art circuit 100 implementing a low drop-out regulator is illustrated. Circuit 100 includes a low drop-out regulator 102 coupled to a downstream circuit device, e.g., a digital signal processor (DSP) 104. At the input of low drop-out regulator 102 is a supply voltage $V_{IN}$, such as a low voltage battery supply of 3.3 volts or less, and an input capacitor $C_1$. At an output $V_{OUT}$ of low drop-out regulator 102, a regulated output of, for example, 2.5 volts can be provided to the downstream circuit elements and devices. In addition, a large load capacitor $C_2$ is provided at output $V_{OUT}$ of low drop-out regulator 102. In addition to enabling low drop-out regulator 102 to be more robust, load capacitor $C_2$ can provide compensation to low drop-out regulator 102 to enable low drop-out regulator 102 to work properly. This compensation of low drop-out regulator 102 can be highly sensitive to the configuration of capacitor $C_2$.

Downstream elements and devices are coupled to output $V_{OUT}$ of low drop-out regulator 102 through various circuit traces and wiring connections. Capacitor $C_2$ also serves as an input capacitor for DSP 104. As the input capacitor, designers of applications for DSP 104 typically require capacitor $C_2$ to comprise between 10 $\mu$F and 100 $\mu$F of capacitance to facilitate noise reduction in DSP 104. Thus, in most applications, capacitor $C_2$ is based on the requirement of the downstream circuit and components, such as DSP 104, rather than the compensation requirements of low drop-out regulator 102. As a result, the design of low drop-out regulator 102, including the compensation requirements, is generally limited by the bypass requirements of the downstream circuit devices and elements.

Input capacitance devices, such as capacitor of DSP 104, also include an equivalent series resistance (ESR) that must be accounted for in the design of low drop-out regulator 102. Further, for downstream circuits with high transient requirements, the total capacitance is ideally configured to tailor the overshoot and undershoot of low drop-out regulator 102. In many instances, the design of a compensation circuit for low drop-out regulator 102 can involve substantial guesswork as to the range of total capacitance, and the ESR of such capacitance, expected to be included within the downstream circuit. Thus, prior art low drop-out regulators, and their required compensation, are generally configured for a particular range of ESR and total capacitance for downstream circuit devices. As a result, circuit designers must pick and choose a particular low drop-out regulator configured for a given ESR and total capacitance of a downstream circuit application.

In addition to the need to identify the capacitance requirements of the downstream circuit in designing the compensation circuit for low drop-out regulator 102, it is also necessary to address poles created within a low drop-out regulator. Whenever a pole is introduced in the frequency response, the gain of low drop-out regulator decreases by more than 20 dB/decade. Poles can be generated or caused by various sources, and occur at various locations within the frequency response of a low drop-out regulator or other output stage circuit. For example, one pole comprising a dominant pole often occurs at a very low frequency, such as 10 Hz; another pole can often occur from an internal loop; and yet another pole can be caused by various parasitics and the $g_m$ in the low drop-out regulator, e.g., the additional pole can be caused in some topologies by the interaction of the low $g_m$ of the error amplifier with the gate capacitance of the typically large common source pass device. With reference to FIG. 2, three such poles are illustrated. However, the frequency responses of low drop-out regulators can include fewer or additional poles to the three types discussed above.

While the first pole is typically not problematic for low drop-out regulator 102, and the third pole can be addressed through use of a pole-zero compensation techniques, such as is disclosed in U.S. patent application Ser. No. 10/107,270, entitled "Output Stage Compensation Circuit", filed on Mar. 25, 2002, and having common inventor and a common assignee as this application, the second pole is more difficult to compensate in low drop-out regulators applications having a large output capacitor $C_2$ with a high ESR. One approach to address the second pole P(2) is to limit the bandwidth of low drop-out regulator 102 by pulling back the dominant first pole P(1) to a lower frequency, thus slowing down low drop-out regulator 102, which results in stable operation at lower currents. However, such bandwidth limitations are problematic for higher current applications, and thus are not favorable.

In addition, prior art low drop-out regulators are required to use smaller sized pass devices with higher resistance values since large sized pass devices are more difficult to control at lower currents. Thus, smaller pass devices having a resistance of 500 mΩ or more require additional supply voltage from battery supplies to provide a desired output voltage.

Accordingly, a need exists for an improved compensation method and circuit for low drop-out regulators that can overcome the various problems of the prior art.

SUMMARY OF THE INVENTION

The method and circuit according to the present invention addresses many of the shortcomings of the prior art. In accordance with various aspects of the present invention, a composite loop compensation circuit and method for a low drop-out regulator configured to facilitate stable operation while providing output voltage and current to downstream circuit devices is provided.

In accordance with an exemplary embodiment, an exemplary low drop-out regulator comprises an error amplifier, a pass device, and a composite loop compensation circuit. The error amplifier is configured to provide an output current that can be configured to drive a control terminal of the pass device, and includes a capacitance device coupled in a feedback arrangement between the output of the error amplifier and the inverting input terminal of the error amplifier. An active resistor component is coupled between an output terminal of the pass device and the inverting input terminal of the error amplifier to provide a composite feedback loop in the low drop-out regulator. The active resistor component and the capacitance device are configured to provide a dominant first pole of the low drop-out regulator.

In accordance with an exemplary embodiment, an exemplary composite loop compensation circuit comprises one or more segmented sense devices configured to drive one or more current sources. Each segmented sense device is configured to sense a suitable range of output load current, i.e., the current from the output terminal of the pass device, and is coupled to a biasing component which controls the biasing of the active resistor. The biasing component is configured with one or more switches coupled to the outputs of one or more segmented current sense devices. Each segmented current sense device along with the biasing component is configured to facilitate compensation for a suitable range of output load current. Composite loop compensation circuit is configured to adjust the dominant first pole of the composite feedback loop based on the biasing current through the active resistor component. As a result, the low drop-out regulator can include a very large pass device for addressing high currents and can remain stable for extremely low currents.

In accordance with another exemplary embodiment, the biasing component is configured to bias the active resistor component through biasing of the control terminal of the active resistor component. In accordance with an exemplary embodiment, the active resistor device comprises a PMOS device and the biasing component comprises a diode-connected PMOS device.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION OF EXEMPLARY EMBODIMENTS OF THE INVENTION

Figure 1:
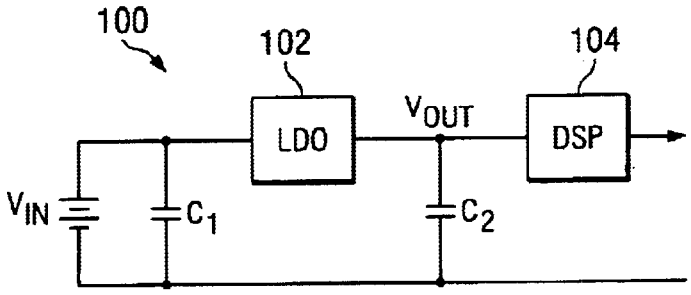
FIG. 1 (PRIOR ART)
FIG. 1 illustrates a schematic diagram of a prior art power supply circuit including a low drop-out regulator configured with a downstream device.
Figure 2:
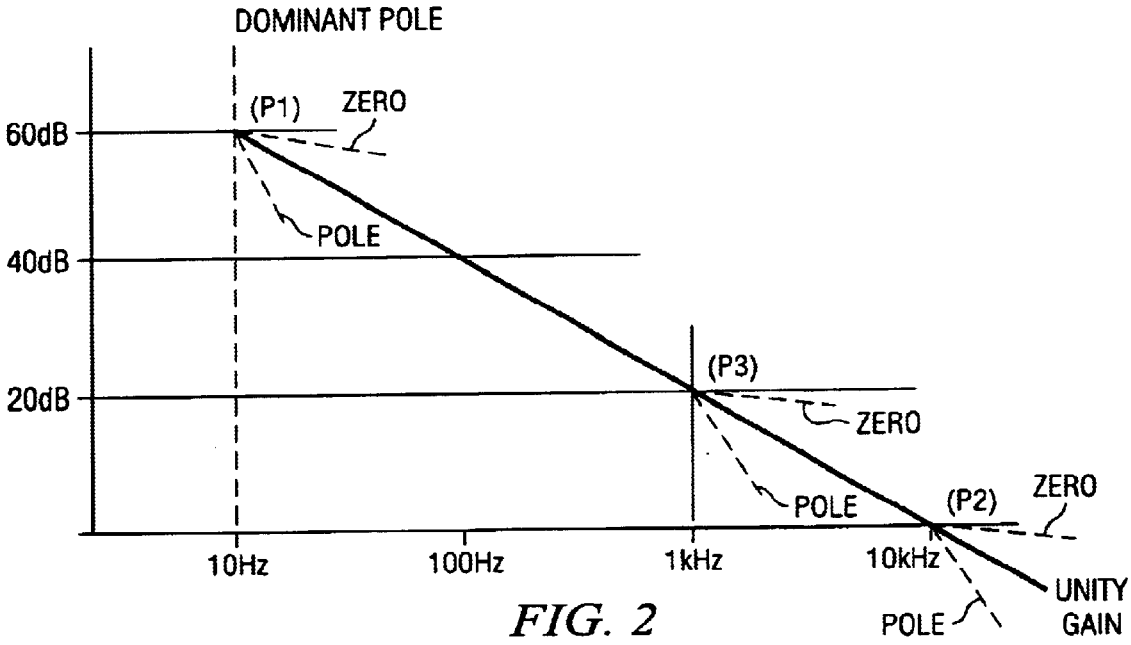
FIG. 2 illustrates a schematic diagram of an exemplary frequency response for a low drop-out regulator.

The present invention may be described herein in terms of various functional components and various processing steps. It should be appreciated that such functional components may be realized by any number of hardware or structural components configured to perform the specified functions. For example, the present invention may employ various integrated components, such as buffers, current mirrors, and logic devices comprised of various electrical devices, e.g., resistors, transistors, capacitors, diodes and the like, whose values may be suitably configured for various intended purposes. In addition, the present invention may be practiced in any integrated circuit application, e.g., any output stage configuration. For purposes of illustration only, exemplary embodiments of the present invention will be described herein in connection with low drop-out regulators. Further, it should be noted that while various components may be suitably coupled or connected to other components within exemplary circuits, such connections and couplings can be realized by direct connection between components, or by connection through other components and devices located thereinbetween.

As discussed above, the compensation of prior art low drop-out regulators is heavily dependent upon the output load current requirements and the load capacitance of downstream circuit devices. Further, prior art low drop-out regulators can have difficulty maintaining stable operation at low output load currents. However, in accordance with various aspects of the present invention, a composite loop compensation circuit and method for a low drop-out regulator configured to facilitate stable operation at very low output load currents is provided.

In accordance with an exemplary embodiment, an exemplary low drop-out regulator comprises an error amplifier, a pass device, and a composite loop compensation circuit. The error amplifier is configured to provide an output load current that can be configured to drive a control terminal of the pass device, and includes a capacitance device coupled in a feedback arrangement between the output of the error amplifier and the inverting input terminal of the error amplifier. An active resistor is coupled between an output terminal of the pass device and the inverting input terminal of the error amplifier to provide a composite feedback loop in the low drop-out regulator. The active resistor component and the capacitance device are configured to provide a dominant first pole of the low drop-out regulator.

An exemplary composite loop compensation circuit comprises one or more segmented sense devices coupled to one or more current sources. Each segmented sense device is configured to sense a suitable range of output load current and is coupled to a biasing component which controls the biasing of said active resistor. The biasing component is configured with one or more switches coupled to the outputs of one or more segmented current sense devices. Each segmented current sense device along with the biasing component is configured to facilitate compensation for a suitable range of output load current. Composite loop compensation circuit is configured to adjust the dominant first pole of the composite feedback loop based on the biasing current through the active resistor component. As a result, the low drop-out regulator can include a very large pass device for addressing high currents and can remain stable for extremely low currents.

Figure 3:
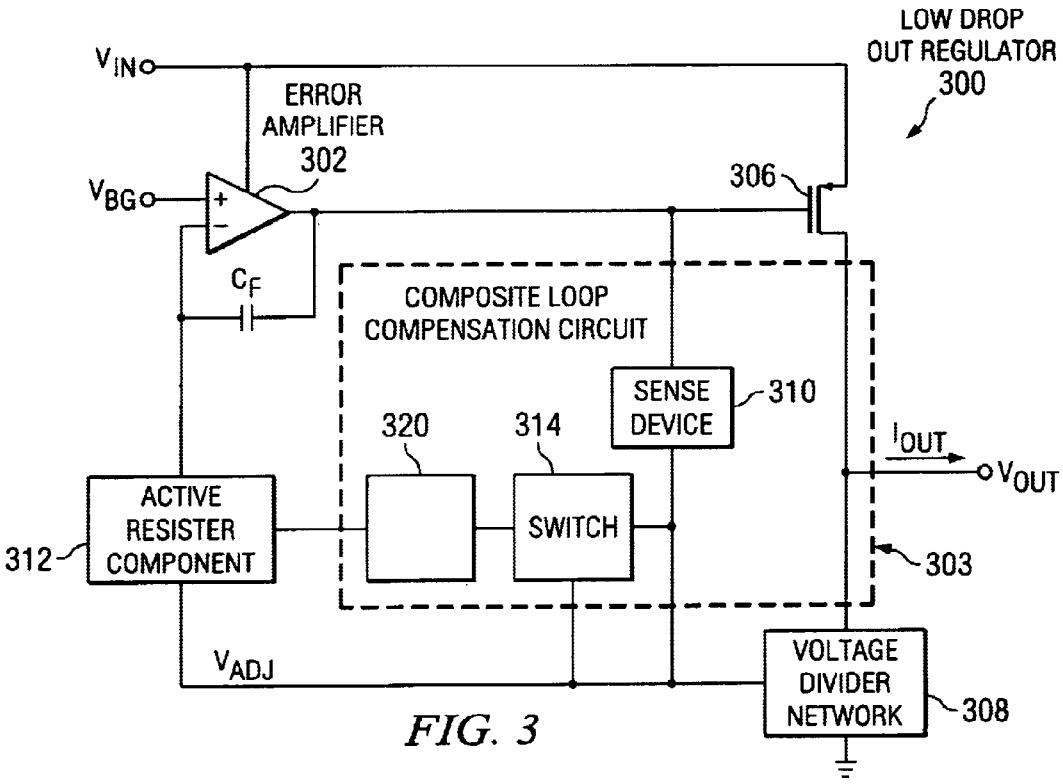
FIG. 3 illustrates a block diagram of an exemplary low drop-out regulator with composite loop compensation in accordance with an exemplary embodiment of the present invention.

With reference to FIG. 3, an exemplary low drop-out regulator 300 with composite loop compensation is illustrated. Low drop-out regulator 300 suitably comprises an error amplifier 302, a pass device 306 and a composite loop compensation circuit 303. Error amplifier 302 is configured to drive a low current during DC conditions, and a high current, e.g., 1 mA, under high slew or transient conditions. Error amplifier 302 can comprise various configurations, such as a single error amplifier, or an error amplifier having a buffer, or a $g_m$ boost, for buffering the output of error amplifier 302, and/or isolating a high output resistance of a gain stage of error amplifier 302. An exemplary error amplifier 302 can comprise a class A-type amplifier device, i.e., an amplifier having a class A output configuration. Error amplifier 302 has a positive input connected to a reference voltage, such as a bandgap voltage $V_{BG}$, configured to provide a stable dc bias voltage with limited current driving capabilities, and is powered by an input supply voltage $V_{IN}$. In addition, error amplifier 302 includes a capacitance device $C_F$ coupled in a feedback arrangement between an output of error amplifier 302 and an inverting input terminal of error amplifier 302.

Pass device 306 comprises a power transistor device configured for driving a load current $I_{OUT}$ to a load device. Pass device 306 has a control terminal suitably coupled to the output of error amplifier 302 to control operation of pass device 306. In the exemplary embodiment, pass device 306 comprises a PMOS transistor device having a source coupled to a supply voltage rail $V_{IN}$, and a drain coupled to a output voltage terminal $V_{OUT}$. However, pass device can comprise any power transistor configuration, such as NPN or NMOS follower transistors, or any other transistor configuration for driving output load current $I_{OUT}$ to a load device. Pass device 306 is configured to source as much current as needed by the load device.

An active resistor component 312 is coupled between an output terminal of pass device 306 and the inverting input terminal of error amplifier 302 to provide a composite feedback loop in low drop-out regulator 300. In accordance with the exemplary embodiment, active resistor component 312 is coupled to a drain terminal of pass device 306 through a voltage divider network 308 and is configured to receive a composite feedback signal $V_{ADJ}$. Active resistor component 312 and capacitance device $C_F$ also comprise an RC network configured to provide a dominant first pole for low drop-out regulator 300.

Composite loop compensation circuit 303 is configured to facilitate stable operation of low drop-out regulator 300 at low currents by adjusting the dominant first pole of a composite loop configuration based on the output load current. In accordance with the exemplary embodiment, composite loop compensation circuit 303 comprises a one or more segmented sense devices 310, one or more switches 314, and a biasing component 320.

Each of the one or more segmented sense devices 310 is configured to facilitate compensation for a suitable range of output load current. In accordance with an exemplary embodiment, a plurality of segmented sense devices 310 comprises a plurality of sense transistors coupled between the upper supply rail $V_{IN}$ and a plurality of current sources connected to the lower supply rail, e.g., ground. However, plurality of segmented sense devices 310 can comprise any device for sensing output load current.

Each of the one or more switches 314 are configured to facilitate biasing of active resistor component 312 based on the output load current sensed by plurality of segmented devices 310. Each switch 314 is suitably coupled with a corresponding segmented sense device of one or more segmented sense devices 310 and is configured to enable biasing component 320 to adjust active resistor component 312 to facilitate compensation of the composite feedback loop based on the output load current. An exemplary switch of one or more switches 314 suitably comprises a transistor-based switch, such as an NMOS transistor device. However, any switch configuration now known or hereinafter devised can be used for one or more switches 314.

To facilitate the adjustment such as the pulling back of the dominant first pole created by the RC network for error amplifier 302, either the resistance of active resistor component 312 or the capacitance of capacitance device $C_F$ can be suitably varied within the RC network. However, varying capacitance device $C_F$ can require significant additional board area. Thus, in accordance with an exemplary embodiment, capacitance device $C_F$ comprises a fixed capacitance device, while active resistor component 312 is readily configurable to various resistance values.

Biasing component 320 is configured to facilitate the adjustment of the resistance of active resistor component 312, such as through the biasing of active resistor component 312, based on the output load current. Biasing component 320 is coupled between one or more switches 314 and active resistor component 312. Biasing component 320 can comprise various configurations for facilitating the adjustment of the resistance of active resistor component 312. In accordance with an exemplary embodiment, the active resistor component 312 comprises a PMOS device and the biasing component 320 comprises a diode-connected PMOS device.

As will be discussed in greater detail below, as the output load current increases or decreases, one or more segmented sense devices 310 can suitably sense the output load current and operate one or more switches 314 to provide active biasing through biasing component 320 to adjust the resistance of active resistor component 312. For example, as the output load current decreases, and various of one or more segmented sense devices 310 are turned off, to suitably operate various of one or more switches 314, active resistor component 312 is biased by biasing component 320 to provide a greater resistance within the RC network of error amplifier 302. Accordingly, composite loop compensation circuit 303 enables the pulling back of the dominant first pole of low drop-out regulator 300 based on the output load current.

Figure 4:
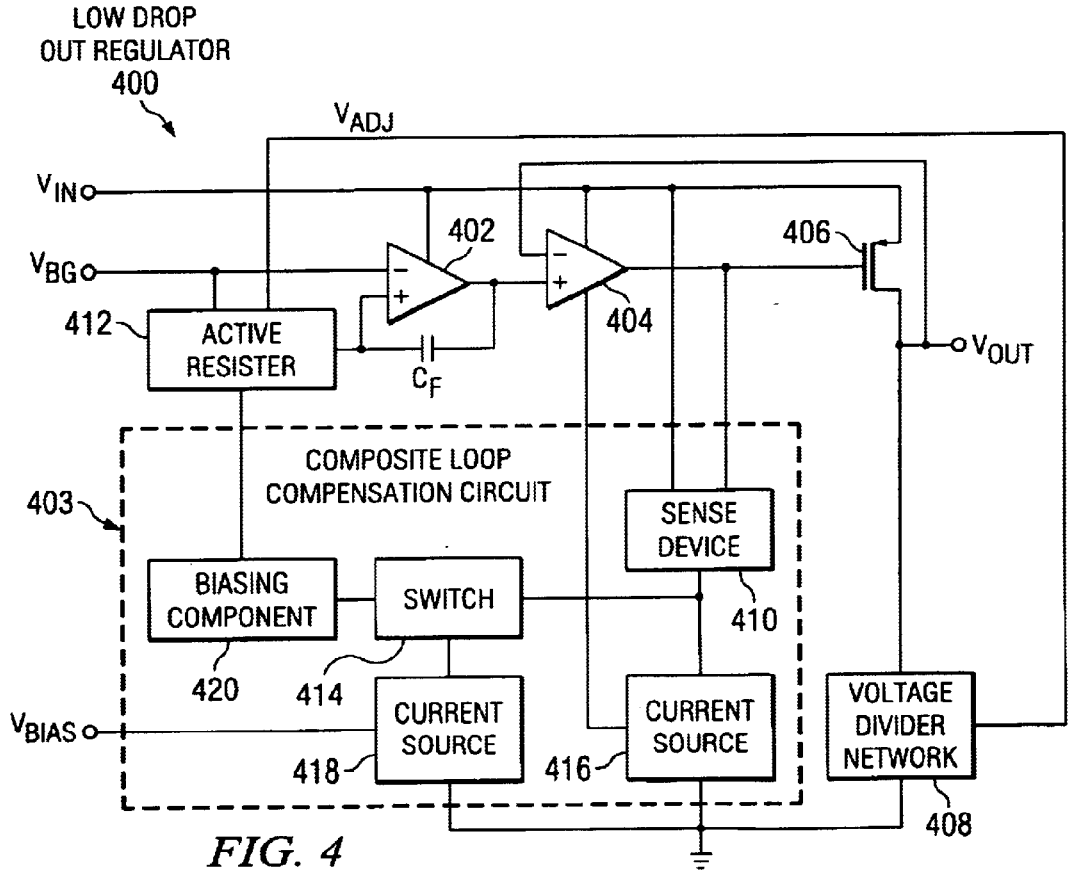
FIG. 4 illustrates a block diagram of another exemplary embodiment of a low drop-out regulator having a current feedback amplifier and with composite loop compensation in accordance with the present invention.

Composite loop compensation circuit 303 can be suitably configured in various arrangements for providing compensation to the composite loop of a low drop-out regulator. Further, composite loop compensation circuit 303 can be suitably configured with any error amplifier and buffer device arrangement. For example, with reference to a low drop-out regulator 400 illustrated in FIG. 4, the composite loop compensation circuit 403 can be suitably configured with pass device 406 coupled to the output of current feedback amplifier 404, within a low drop-out regulator 400. Such an exemplary embodiment of low drop-out regulator 400 is disclosed more fully in U.S. patent application Ser. No. 10/151,366, entitled "Low Drop-Out Regulator Having Current Feedback Amplifier and Composite Feedback Loop", filed on May 20, 2002, and having a common inventor and common assignee as the present application, and hereby incorporated herein by reference.

Low drop-out regulator 400 is configured with current feedback amplifier 404 being decoupled from the overall composite feedback configuration, e.g., a composite feedback loop being coupled from a voltage divider circuit 408 to the inverting input terminal of error amplifier 402, and configured to provide effective buffering of error amplifier 402. As a result, current feedback amplifier 404 can be configured to operate with low current supplied from error amplifier 402 and to drive a control terminal of a pass device 406 with sufficiently high current as demanded by a load device.

In accordance with an exemplary embodiment, composite loop compensation circuit 403 is configured to facilitate stable operation of low drop-out regulator 400 at very low currents by pulling back the dominant first pole of a composite loop configuration, i.e., the pole created by the RC network comprising active resistor 412 and capacitance device $C_F$, based on the output load current i.e., the current from the output terminal of the pass device. In accordance with this exemplary embodiment, composite loop compensation circuit 403 comprises a plurality of segmented sense devices 410, a plurality of switches 414 and a biasing component 420. However, composite loop compensation circuit 403 can also be suitably configured with a single segmented sense device and a single switch.

Plurality of segmented sense devices 410 are configured to sense an output load current of current feedback buffer 404. Each of plurality of segmented sense devices 410 is configured to facilitate compensation for a suitable range of output load current. To facilitate operation of plurality of segmented sense devices 410, composite loop compensation circuit 403 can also include a first plurality of current sources 416. First plurality of current sources 416 are suitably configured to supply current to each of plurality of segmented sense devices 410. An exemplary segmented sense device of segmented sense device 410 suitably comprises a sense transistor having an input terminal coupled to upper supply rail voltage $V_{IN}$, a control terminal coupled to the output of current feedback amplifier 404, and an output terminal coupled to a corresponding current source of plurality of current sources 416.

Plurality of switches 414 are configured to facilitate biasing of an active resistor component 412 based on the output load current sensed by plurality of segmented devices 410. Each of plurality of switches 414 is suitably coupled with a corresponding segmented sense device of plurality of segmented sense devices 410 and is configured to enable biasing component 420 to adjust active resistor component 412 to facilitate compensation of the composite feedback loop based on the output load current. An exemplary switch of plurality of switches 414 suitably comprises a transistor-based switch, such as an NMOS transistor device. However, any switch configuration now known or hereinafter devised can be used for plurality of switches 414, such as bipolar configurations and the like.

To facilitate operation of plurality of switches 414, composite loop compensation circuit 403 can also include a second plurality of current sources 418. Second plurality of current sources 418 are suitably configured to received a bias voltage signal $V_{BIAS}$ and to supply current to each of plurality of switches 414. An exemplary switch of plurality of switches 414 suitably comprises a transistor device having an input terminal coupled to a corresponding current source of second plurality of current sources 418, a control terminal coupled to the output terminal of a corresponding segmented sense device of plurality of segmented sense devices 410, and an output terminal coupled to biasing component 420.

Biasing component 420 is configured to facilitate adjust the resistance of active resistor component 412 to enable the pulling back of the dominant first pole created by the RC network for error amplifier 402, i.e., the RC network comprising the resistance within active resistor 412 and the capacitance of device $C_F$, based on the output load current. Biasing component 420 is coupled between plurality of switches 414 and active resistor component 412. Biasing component 420 can comprise various configurations for facilitating the adjustment of the resistance of active resistor component 412. In accordance with an exemplary embodiment, the active resistor component 412 comprises a PMOS device and the biasing component 420 comprises a diode-connected PMOS device.

In accordance with an exemplary embodiment, capacitance device $C_F$ comprises a fixed capacitance device, while active resistor component 412 is readily configurable to various resistance values. Active resistor component 412 suitably comprises a transistor device having a control terminal biased by biasing component 420 through operation of plurality of switches 414. For example, as the output load current decreases, various of plurality of segmented sense devices 410 are configured to suitably operate various of plurality of switches 414. As various of plurality of switches 414 are turned off, corresponding current sources of second plurality of current sources 418 are suitably coupled to biasing component 420 to facilitate biasing of active resistor component 412 to provide a greater resistance within the RC network of error amplifier 302. Accordingly, composite loop compensation circuit 403 provides the pulling back of the dominant first pole of low drop-out regulator 400 based on the output load current.

Figure 5:
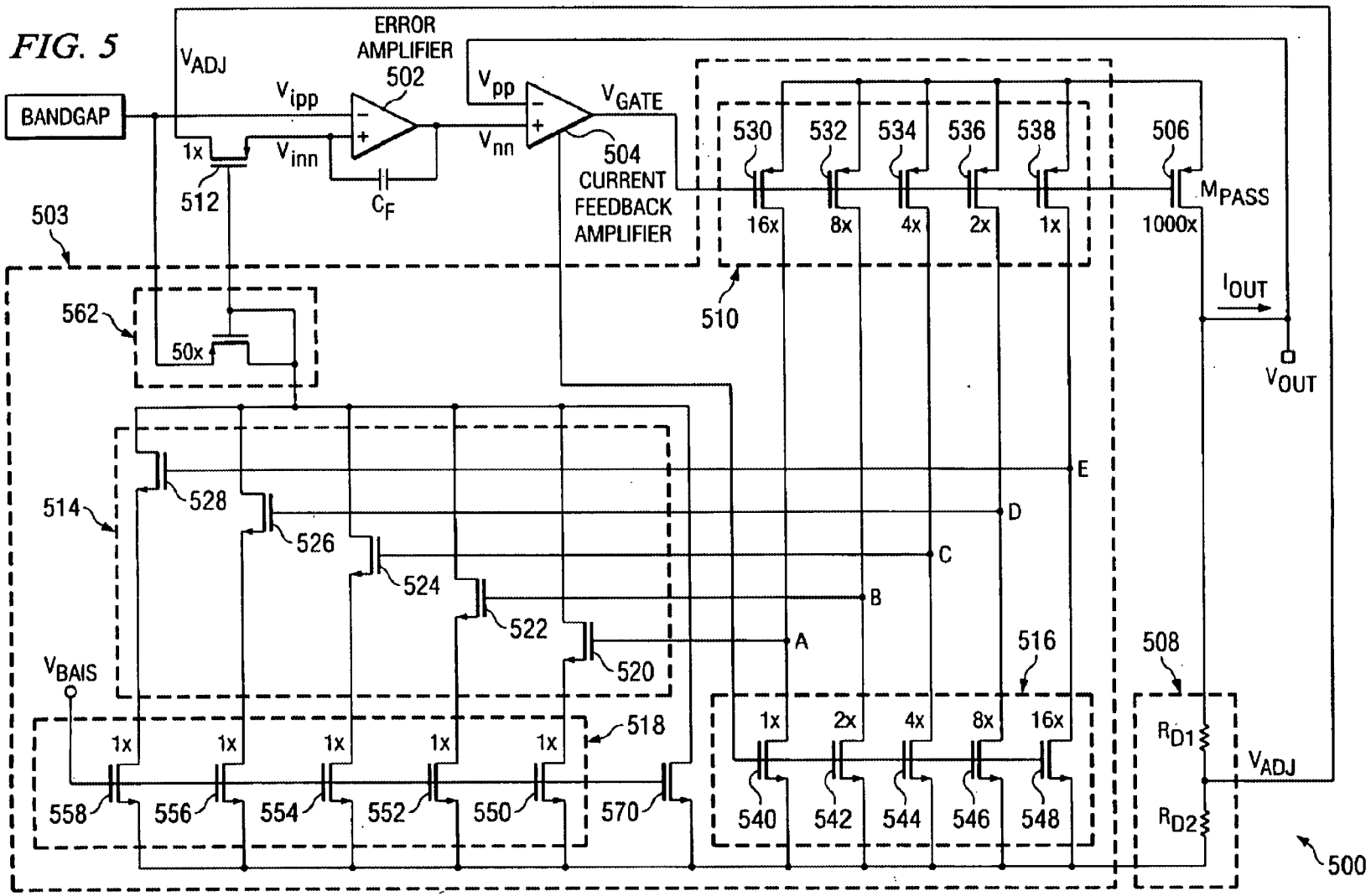
FIG. 5 illustrates a schematic diagram of an exemplary composite loop compensation for a low drop-out regulator in accordance with another exemplary embodiment of the present invention.

Having described an exemplary composite loop compensation scheme for a low drop-out regulator, a more detailed illustration in accordance with an exemplary embodiment can be provided. With reference to FIG. 5, a low drop-out regulator 500 can be provided with a composite loop compensation circuit 503. In this exemplary embodiment, low drop-out regulator 500 is configured with an error amplifier 502, a current feedback amplifier 504, a pass device 506, and a divider network 508, such as disclosed more fully in U.S. patent application Ser. No. 10/151,366, entitled "Low Drop-Out Regulator Having Current Feedback Amplifier and Composite Feedback Loop", filed on May 20, 2002, and having a common inventor and common assignee as the present application, and hereby incorporated herein by reference. However, it should be noted that low drop-out regulator 500 is merely for illustrative purposes, and composite loop compensation circuit 503 can be suitably configured with any configuration of low drop-out regulator.

In accordance with this exemplary embodiment, low drop-out regulator 500 suitably comprises an error amplifier 502, a current feedback amplifier 504, a pass device 506, a composite loop compensation circuit 503, and a divider network 508. Low drop-out regulator 500 includes a composite amplifier feedback configuration, with a local feedback loop of current feedback amplifier 504 being decoupled from the overall composite feedback loop. In addition, while low drop-out regulator 500 suitably comprises MOS transistor devices in the exemplary embodiment, bipolar devices can also be utilized.

Error amplifier 502 suitably comprises a class A device configured to control the gain and offset of low drop-out regulator 500. A positive input terminal is coupled to a reference voltage, such as a bandgap reference voltage $V_{BG}$, while a negative input terminal is configured to receive a composite feedback signal from a resistor network 508, e.g., from a node $V_{ADJ}$, through an active resistor 512 at an inverting input terminal. In addition, error amplifier 502 includes a capacitance device $C_F$ coupled in a feedback arrangement between an output of error amplifier 502 and the inverting input terminal of error amplifier 502.

Current feedback amplifier 504 is configured to operate with low input current from error amplifier 502 and to suitably provide an output current to drive a control terminal of pass device 506, i.e., $M_{PASS}$. In the exemplary embodiment, current feedback amplifier 504 is configured to receive an output signal from error amplifier 502 at an inverting input terminal. Current feedback amplifier 504 utilizes a unity gain feedback loop coupled from an output of pass device 506 to the inverting input terminal, i.e., a feedback loop decoupled from the composite amplifier loop.

Pass device 506 comprises a power transistor device configured for driving an output load current $I_{OUT}$ to a load device through an output terminal $V_{OUT}$. In the exemplary embodiment, pass device 506 comprises a PMOS transistor device having a source coupled to a supply voltage rail $V_{IN}$, gate coupled to current feedback output terminal $V_{GATE}$, and a drain coupled to a output voltage terminal $V_{OUT}$. However, pass device can comprise any power transistor configuration. Pass device 506 is configured to source as much current as needed by the load device and/or divider network 508.

Divider network 508 suitably comprises a resistive divider configured for providing a composite feedback signal. In the exemplary embodiment, divider network 508 comprises a pair of resistors $R_{D1}$ and $R_{D2}$. Resistor $R_{D1}$ is coupled between the drain of pass device 506 and resistor $R_{D2}$, while resistor $R_{D2}$ is connected to a low supply rail, e.g., to ground. A composite feedback signal can be provided from a node $V_{ADJ}$ configured between resistors $R_{D1}$ and $R_{D2}$.

Active resistor component 512 is coupled between node $V_{ADJ}$ and the inverting input terminal of error amplifier 502 to provide a composite feedback loop in low drop-out regulator 500. In accordance with the exemplary embodiment, active resistor component 512 comprises a transistor device having a source terminal coupled to a drain terminal of pass device 506 through a voltage divider network 508 and configured to receive a composite feedback signal $V_{ADJ}$, and a drain coupled to the inverting input terminal of error amplifier 502. Active resistor component 512 and capacitance device $C_F$ also comprise an RC network configured to provide a dominant first pole for low drop-out regulator 500.

During operation of error amplifier 502, current feedback amplifier 504, and pass device 506, under normal DC conditions where the output load current $I_{OUT}$ at output terminal $V_{OUT}$ is in a steady state, error amplifier 502 is configured to provide a voltage equal to that of the voltage at output terminal $V_{OUT}$, and a low input current to the non-inverting input terminal of current feedback amplifier 504. When a transient event occurs at the output load, e.g., an increase or decrease in output load current $I_{OUT}$ demanded by the output load, current feedback amplifier 504 is configured to provide a high output current to drive pass device 506, while only receiving a low input current from error amplifier 502, and an additional current from capacitance device $C_F$.

Composite loop compensation circuit 503 is configured to facilitate stable operation of low drop-out regulator 500 at very low currents by pulling back the dominant first pole of a composite loop configuration, i.e., the pole created by the RC network comprising active resistor 512 and capacitance device $C_F$, based on the output load current i.e., the current from the output terminal of the pass device 506. Composite loop compensation circuit 503 comprises a plurality of segmented sense devices 510, a plurality of switches 514, and a biasing component 562.

In accordance with this exemplary embodiment, composite loop compensation circuit 503 includes five segmented sense devices 530, 532, 534, 536 and 538, and five corresponding switches 520, 522, 524, 526 and 528. However, it should be noted that exemplary composite loop compensation circuit 503 is for illustration purposes only, and that various other configurations of plurality of segmented sense devices 510 and plurality of switches 514 can also be realized, such as one, two, three, four, or more such devices and switches.

Segmented sense devices 530, 532, 534, 536 and 538 are configured to facilitate compensation for a suitable range of output load current. Segmented sense devices 530, 532, 534, 536 and 538 suitably comprise a sense transistor having a source coupled to upper supply rail voltage $V_{IN}$, a gate coupled to the output terminal $V_{GATE}$ of current feedback amplifier 504, and a drain coupled to a corresponding switches 520, 522, 524, 526 and 528, respectively. In that all of the gates of segmented sense devices 530, 532, 534, 536 and 538 are commonly tied to a node $V_{GATE}$, each of segmented sense devices 530, 532, 534, 536 and 538 are configured to be driven by, and thus sense, the same output signal provided to the gate of pass device 506.

The compensation for the various ranges of output load current can be overlapped by the plurality of segmented sense devices 530, 532, 534, 536 and 538. Further, segmented sense devices 530, 532, 534, 536 and 538 can be configured as scale devices to suitably cover the various ranges of current. For example, the scaling of segmented sense devices 530, 532, 534, 536 and 538 can be configured over various ranges, such as octave, decade or other scaling ranges.

In accordance with an exemplary embodiment, the scaling of segmented sense devices 530, 532, 534, 536 and 538 can be configured in an octave scaling arrangement, i.e., binary scaled devices, with the size of sense device 530 configured as a 16× device, sense device 532 configured as a 8× device, sense device 534 configured as a 4× device, sense device 536 configured as a 2× device, and sense device 538 configured as a 1× device. The largest device, i.e., sense device 530 with a 16× size, is configured to operate when the output signal of current feedback amplifier 504 is extremely low, e.g., close to the Vin rail. On the other hand, the smallest device, i.e., sense device 538 with a 1× size, is configured to operate when the output signal of current feedback amplifier 504 is large, e.g., close to the lower supply rail, e.g., ground.

In addition, although not illustrated in FIG. 5, each of segmented sense devices 530, 532, 534, 536 and 538 can also include a compensation capacitor, such as capacitors $C_1$, $C_2$, $C_3$, $C_4$ and $C_5$, respectively, coupled to their gate and drain terminals. Compensation capacitors $C_1$, $C_2$, $C_3$, $C_4$ and $C_5$ can be suitably configured to provide the pole compensation for the third pole P(3), such as disclosed more fully in U.S. patent application Ser. No. 10/107,270, entitled "Output Stage Compensation Circuit", filed on Mar. 25, 2002, having a common inventor and common assignee as the present application, and hereby incorporated herein by reference. Segmented sense devices 530, 532, 534, 536 and 538 can be configured to adjust the pole compensation by multiplying the effect of compensation capacitors $C_1$, $C_2$, $C_3$, $C_4$ and $C_5$.

To facilitate operation of plurality of segmented sense devices 510, composite loop compensation circuit 503 can also include a first plurality of current sources 516. First plurality of current sources 516 are suitably configured to supply current to each of plurality of segmented sense devices 510. In accordance with the exemplary embodiment, first plurality of current sources 516 comprises five current sources 540, 542, 544, 546 and 548 suitably configured to supply current to each of segmented sense devices 530, 532, 534, 536 and 538, respectively. Current sources 540, 542, 544, 546 and 548 are configured as fixed current sources under DC conditions, and as active current sources under transient conditions. Current sources 540, 542, 544, 546 and 548 can comprise active current sources to suitably increase an effective range of compensation for a range of output current. Current sources 540, 542, 544, 546 and 548 comprise NMOS devices configured with drains coupled to the drains of segmented sense devices 530, 532, 534, 536 and 538, respectively, sources coupled to the lower supply rail, e.g., to ground, and gates driven by the signal supplied from current feedback amplifier 504.

Current sources 540, 542, 544, 546 and 548 can also be suitably scaled to supply various amounts of current, i.e., scaled over various ranges, such as octave, decade or other scaling ranges. In accordance with the exemplary embodiment, current sources 540, 542, 544, 546 and 548 are suitably scaled in an octave scaling arrangement, i.e., binary scaled current sources, with the size of current source 540 configured as a 1× device, current source 542 configured as a 2× device, current source 544 configured as a 4× device, current source 546 configured as a 8× device, and current source 548 configured as a 16× device. Accordingly, the largest sense device, segmented sense device 530 is configured with the smallest current source, i.e., current source 540. On the other hand, the smallest sense device, i.e., sense device 538 with a 1× size, is configured to operate with the largest current source, i.e., current source 548.

Plurality of switches 514 can comprise switches 520, 522, 524, 526 and 528 configured to facilitate biasing of active resistor 512 based on the output load current sensed by plurality of segmented devices 510. Switches 520, 522, 524, 526 and 528 are suitably coupled to segmented sense devices 530, 532, 534, 536 and 538, respectively, and are configured to enable biasing component 562 to adjust active resistor 512 to facilitate compensation of the composite feedback loop based on the output load current. Switches 520, 522, 524, 526 and 528 suitably comprise transistor devices configured as switches, with a source terminal coupled to a current source, a gate terminal coupled to a drain terminal of segmented sense devices 530, 532, 534, 536 and 538, respectively, and a drain terminal coupled to biasing component 562.

To facilitate operation of plurality of switches 514, in accordance with this exemplary embodiment, composite loop compensation circuit 503 can also include a second plurality of current sources 518 comprising second current sources 550, 552, 554, 556 and 558. Second plurality of current sources 550, 552, 554, 556 and 558 are suitably configured to received a bias voltage signal $V_{BIAS}$ and to supply current to biasing component 562 through operation of switches 520, 522, 524, 526 and 528, respectively. Second plurality of current sources 550, 552, 554, 556 and 558 suitably comprise a transistor device having a source coupled to a lower supply rail, e.g., to ground, a gate coupled to bias voltage signal $V_{BIAS}$, and a drain coupled to the source of switches 520, 522, 524, 526 and 528, respectively.

In addition to creating the dominant pole along with capacitance device $C_F$, active resistor 512 is also configured to facilitate the pulling back of the dominant first pole of the composite loop configuration based on the output load current. In accordance with an exemplary embodiment, capacitance device $C_F$ comprises a fixed capacitance device, while active resistor 512 is readily configurable to various resistance values through operation of composite loop compensation circuit 503. In addition to having a source terminal configured to receive a composite feedback signal from node $V_{ADJ}$ of divider network 508, and a drain coupled to the inverting input terminal of error amplifier 502 and to capacitance device $C_F$, active resistor 512 also suitably comprises a gate terminal biased by a biasing component 562. In addition, the capacitor area for capacitance device $C_F$ for use with active resistor 512 within the RC network is small, resulting in lower die costs.

Biasing component 562 is suitably configured to bias the gate terminal of active resistor 512 to suitably change the resistance value of active resistor 512 based on the output load current. In accordance with the exemplary embodiment, biasing component 562 suitably comprises a diode-connected transistor device having a source coupled to reference voltage, $V_{BG}$, and a gate and drain coupled to plurality of switches 514, e.g., to the drain terminals of switches 520, 522, 524, 526 and 528.

Active resistor 512 and biasing component 562 can be suitably matched devices with suitable scaling. For example, in accordance with the exemplary embodiment, active resistor 512 and biasing component 562 can be configured as 1× and 50× sized devices, such that 1/50 of the current flowing through biasing component 562 flows through resistive device 560. However, other scaling configurations for the size of active resistor 512 and biasing component 562 can also be realized.

To further illustrate the benefits of composite loop compensation circuit 503, operation of low drop-out regulator 500 can be provided. Initially, when the output load current $I_{OUT}$ is zero, $V_{GATE}$ voltage is extremely low, e.g., close to the upper supply rail Vin, each of nodes A, B, C, D and E, corresponding to the drains of segmented sense devices 530, 532, 534, 536 and 538, respectively, will be pulled to the lower rail, e.g., to ground, by current sources 540, 542, 544, 546 and 548. However, as the output load increases, output signal $V_{GATE}$ of current feedback amplifier 504 will also increase, e.g., move closer to ground. Segmented sense device 530, being the largest device, will begin to turn on to sense the output current, and will draw current from current source 540, which will pull up node A towards upper rail supply $V_{IN}$. As node A is pulled upwards, the gate of switch 520 is also pulled upwards to turn on switch 520. As switch 520 is turned on, current source 550 is suitably connected to biasing component 562 to allow current to flow through biasing component 562. Biasing component 562 operates to change the biasing to the gate of active resistor 512 to suitably decrease the effective resistance of active resistor 512.

As the output signal $V_{GATE}$ of current feedback amplifier 504 continued to increase, segment sense device 532, being the second largest device, will begin to turn on during sensing of the output current, drawing current from current source 542, and will pull up node B towards upper rail supply $V_{IN}$. As node B is pulled upwards to turn on switch 522, additional current from current source 552 will begin to flow to biasing component 562. Likewise, as the output signal $V_{GATE}$ from current feedback amplifier 504 continues to increase, segment sense devices 534, 536 and 538, being the next consecutively-decreasing sized devices, will begin to suitably turn on to also sense the output load current, and will draw current from current sources 544, 546 and 548, respectively, which will pull up nodes C, D and E towards upper rail supply $V_{IN}$. As a result, switches 524, 526, and 528 can also be suitably enabled to allow additional current from current sources 554, 556 and 558 to flow to biasing component 562, thus suitably lowering the effective resistance of active resistor 512.

Each node A, B, C, D and E will continue to be pulled up approximate to the upper rail supply $V_{IN}$, until the corresponding sense device 530, 532, 534, 536 or 538 cannot draw any additional current. Thus, for an exemplary embodiment having 1 mA of output load current, nodes A, B, C, D and E can be suitably configured to turn on switches 520, 522, 524, 526 and 528, allowing current from each of current sources 550, 552, 554, 556 or 558 to flow to biasing component 562.

On the other hand, as the output signal $V_{GATE}$ of current feedback buffer amplifier 504 decreases, e.g., moves closer to the upper supply rail Vin, nodes E, D, C, B and A will be pulled downwards, such as through current sources 548, 546, 544, 542 and 540, respectively, thus shutting off switches 528, 526, 524, 522 and 520. Accordingly, the flow of additional current to biasing component 562 from current sources 550, 552, 554, 556 or 558 will be suitably decreased, thus increasing the effective resistance of active resistor 512.

In accordance with an exemplary embodiment, biasing component can be configured with an upper and lower biasing limit to provide an upper and lower resistance value for active resistor 512. To provide a lower biasing limit, i.e., the lower effective resistance of active resistor 512, composite loop compensation circuit 503 is configured with a limited number of switches in plurality of switches 514 and current sources in second plurality of current sources 518, such as five switches 520, 522, 524, 526 and 528 and current sources 550, 552, 554, 556, and 558. Additional switches 514 and current sources 518 can operate to further provide a lower limit to the effective resistance, while fewer switches and current sources can increase the lower limit.

For good stability, it may be desirable to cover a lower output load current range, such as a range of 1 mA of output load current, which can be provided with, for example, between four and six switches and current sources. It should be noted, however, that other numbers of switches and current sources can also be realized for providing lower output load current ranges. In addition, at higher output load current levels, e.g., greater than 1 ma, the problems associated with the second pole can be suitably addressed such that additional switches 514 and current sources 518 provide minimal additional compensation. However, composite loop compensation circuit 503 can include additional segmented current sources within plurality of segmented current sources 510 that are not corresponding to a switch within plurality of switches 514. For example, an exemplary composite loop compensation circuit 503 can include additional six, eight, ten or more, or any other number of segmented current sources within plurality of segmented current sources 510 configured for handling higher currents that do not correspond to a switch within plurality of switches 514.

To provide an upper biasing limit, biasing component 562 can be provided with a minimum amount of current at all times, regardless if plurality of switches 514 and second plurality of current sources 518 are operating. In accordance with an exemplary embodiment, composite loop compensation circuit 503 can suitably include a limiting current source 570 configured to provide at least a minimum amount of current to biasing component 562. Current source 570 can include a source coupled to a lower rail supply, e.g., ground, and a drain coupled to the gate and drain of biasing component 562. To operate current source 570, a gate can be coupled to a voltage source, such as $V_{BIAS}$, or any other voltage source for driving the gate of current source 570. Accordingly, with at least a minimum amount of current provided from current source 570 to biasing component 562, an upper biasing limit, and thus upper limit of effective resistance of active resistor 512, can be realized.

In addition, through operation of composite loop compensation circuit 503 at lower currents, pass device 506 can be configured as a larger device which comprises a lower resistance. A lower resistance pass device 506 will enable the supply voltage $V_{IN}$, such as from a battery supply, to be further discharged than if pass device 506 has a higher resistance. For example, with a larger pass device 506 having a resistance of 200 mΩ or less, and with 1A of output current, only 2.7 volts or less of supply voltage $V_{IN}$ is required to provide an output voltage of 2.5 volts, as opposed to 3.0 volts or more required with use of smaller pass devices having a resistance of 500 mΩ or more. Accordingly, larger sized pass devices 506 can be utilized at higher currents, but low drop-out regulator 500 can still be stable at lower currents.

The present invention has been described above with reference to various exemplary embodiments. However, those skilled in the art will recognize that changes and modifications may be made to the exemplary embodiments without departing from the scope of the present invention. For example, the various components may be implemented in alternate ways, such as, for example, by implementing BJT devices for the various switching devices. Further, the various exemplary embodiments can be implemented with other types of operational amplifier circuits in addition to the circuits illustrated above. These alternatives can be suitably selected depending upon the particular application or in consideration of any number of factors associated with the operation of the system. Moreover, these and other changes or modifications are intended to be included within the scope of the present invention, as expressed in the following claims.

What is claimed is:

1. A low drop-out regulator for providing an output voltage to a load device, said low drop-out regulator comprising:

a pass device comprising a power transistor having an output terminal configured for providing the output voltage to the load device;

an error amplifier having an output terminal providing a current configured for driving said pass device, said error amplifier having a capacitor device configured between said output terminal and an inverting input terminal of said error amplifier;

an active resistor configured between said output terminal of said pass device and said inverting input terminal of said error amplifier to provide a composite loop; and a composite loop compensation circuit comprising:

at least one segmented sense device configured for sensing an output load current delivered by said pass device;

a least one switch coupled to said at least one segmented sense device; and a biasing component coupled between said at least one switch and said active resistor, said biasing component being configured for biasing said active resistor to adjust a dominant first pole created by said active resistor and said capacitor device based on said output load current delivered by said pass device.

2. The low drop-out regulator according to claim 1, wherein said composite loop compensation circuit further comprises at least one current source corresponding to said at least one segmented sense device, said at least one current source being configured to supply current to said at least one segmented sense device.

3. The low drop-out regulator according to claim 2, wherein said composite loop compensation circuit comprises a plurality of segmented sense devices, a plurality of switches, and a plurality of current sources, said plurality of current sources corresponding to said plurality of segmented sense devices and being configured to supply current to said plurality of segmented sense devices.

4. The low drop-out regulator according to claim 3, wherein each of said plurality of segmented sense devices comprises a sense transistor having a source coupled to an upper supply rail, a control terminal coupled to a control terminal of said pass device, and an output terminal coupled to one of said plurality of current sources.

5. The low drop-out regulator according to claim 3, wherein plurality of current sources comprise active current sources to increase an effective range of compensation for a range of said output load current.

6. The low drop-out regulator according to claim 3, wherein said plurality of segmented sense devices and said plurality of current sources are scaled to compensate various ranges of output current.

7. The low drop-out regulator according to claim 6, wherein said segmented sense devices are increasingly scaled in one of an octave and a decade scale.

8. The low drop-out regulator according to claim 7, wherein said plurality of current sources are scaled in a manner inversely proportional to said segmented sense devices.

9. The low drop-out regulator according to claim 1, wherein said low drop-out regulator further comprises a current feedback amplifier coupled to an output terminal of said error amplifier and configured to provide said output current for driving said control terminal of said pass device.

10. The low drop-out regulator according to claim 3, wherein said composite loop compensation circuit further comprises a second plurality of current sources configured to receive a bias voltage signal and to supply current to each of said plurality of switches to facilitate operation of said biasing component.

11. The low drop-out regulator according to claim 10, wherein said biasing component is configured with an upper and lower biasing limit to provide an upper and lower resistance value for said active resistor through selection of a number of said second plurality of current sources and said plurality of switches.

12. The low drop-out regulator according to claim 10, wherein said composite loop compensation circuit further comprises a limiting current source coupled to said biasing component, said limiting current source configured to provide at least a minimum amount of current to said biasing component.

13. A composite loop compensation circuit for compensation of an output stage having a pass device, said composite loop compensation circuit comprising:

at least one segmented sense device configured for sensing an output current delivered to the pass device, said at least one segmented sense device having a control terminal configured for coupling to a control terminal of the pass device;

a least one switch having a control terminal coupled to an output terminal of said at least one segmented sense device; and a biasing component coupled between said at least one switch and said output stage, said biasing component being configured for biasing said output stage to adjust a dominant first pole based on the output current delivered to the pass device.

14. The composite loop compensation circuit according to claim 13, wherein said composite loop compensation circuit further comprises a least one current source configured for supplying current to said at least one segmented sense device.

15. The composite loop compensation circuit according to claim 14, wherein said composite loop compensation circuit further comprises at least one other current source coupled to said at least one switch, said at least one other current source configured for supplying current to said biasing component.

16. The composite loop compensation circuit according to claim 15, wherein said composite loop compensation circuit comprises a plurality of segmented sense devices, a plurality of switches, and a plurality of first current sources, and a plurality of second current sources, said plurality of first current sources corresponding to said plurality of segmented sense devices and being configured to supply current to said plurality of segmented sense devices, said plurality of second current sources being configured to receive a bias voltage signal and to supply current to each of said plurality of switches to facilitate operation of said biasing component.

17. The composite loop compensation circuit according to claim 16, wherein said biasing component is configured with an upper and lower biasing limit to provide an upper and lower resistance value for said active resistor through selection of a number of said second plurality of current sources and said plurality of switches.

18. The composite loop compensation circuit according to claim 17, wherein said composite loop compensation circuit further comprises a limiting current source coupled to said biasing component, said limiting current source configured to provide at least a minimum amount of current to said biasing component.

19. A method for compensation of a composite loop of a low drop-out regulator, said compensation method comprising the steps of:

sensing an output current provided to a control terminal of a pass device with a first segmented sense device; and supplying a biasing current through a biasing component to adjust an effective resistance within an active resistor component of the low drop-out regulator, thereby adjusting a dominant first pole created by the active resistor an a capacitor device.

20. The method according to claim 19, wherein said method further comprises the steps of:

sensing said output current provided to said control terminal of said pass device with a second segmented sense device, said second segmented sense device being configured to sense said output current at an increased current level, said second segmented sense device comprising a smaller transistor device than said first segmented sense device; and compensating said low drop-out regulator through adjustment of said biasing current through turning on switches corresponding to said output current sensed by said first segmented sense device and said second segmented sense device.

21. The method according to claim 19, wherein said method further comprises the steps of:

sensing said output current provided to said control terminal of said pass device with a plurality of segmented sense devices, said plurality of segmented sense devices being configured to sense said output current at successively increasing current levels, said plurality of segmented sense devices comprising successively smaller transistor devices than said first segmented sense device; and compensating said low drop-out regulator through adjustment of said biasing current through selectively turning on switches corresponding to said output current sensed by said plurality of segmented sense devices.

22. The method according to claim 21, wherein said step of sensing said output current provided to said control terminal of said pass device comprises sensing with said plurality of segmented sense devices coupled to a plurality of active current sources to increase an effective range of compensation for a range of said output current.

23. The method according to claim 19, wherein said step of compensating said low drop-out regulator comprises using an upper and lower biasing limit to provide an upper and lower resistance value for said active resistor component.

24. The method according to claim 19, wherein said step of compensating said low drop-out regulator comprises providing a minimum amount for said biasing current.

25. The method according to claim 23, wherein said step of compensating comprises configuring said active resistor component to be a substantially smaller fraction in device size than a biasing component.

* * * * *